US005697178A

United States Patent [19]

Haskell

[11] Patent Number: 5,697,178

[45] Date of Patent: Dec. 16, 1997

[54] FIRE CONTROL MECHANISM FOR FIREARMS

[76] Inventor: Philip R. Haskell, 276 Center Rd. P. O. Box No. 75, Easton, Conn. 06612

[21] Appl. No.: 493,895

[22] Filed: Jun. 23, 1995

[51] Int. Cl.[6] ..... F41A 17/00

[52] U.S. Cl. ..... 42/70.04; 42/70.05; 42/70.06; 89/144

[58] Field of Search ..... 42/70.04, 70.05, 42/70.06; 89/144, 148, 27.12

[56] References Cited

U.S. PATENT DOCUMENTS

| | | | |
|---|---|---|---|
| 817,004 | 4/1906 | Rogers et al. | 42/70.04 |
| 1,855,403 | 4/1932 | Loomis | 42/70.04 |
| 2,675,638 | 4/1954 | Crittendon | 42/70.05 |
| 2,783,569 | 3/1957 | Claesson | 42/70.06 |
| 2,856,718 | 10/1958 | Fischer | 42/70.04 |
| 5,068,990 | 12/1991 | Marzocco | 42/70.04 |

*Primary Examiner*—J. Woodrow Elored
*Attorney, Agent, or Firm*—Patrick J. Walsh

[57] ABSTRACT

An improved fire control mechanism for firearms in which a connector is interposed between the trigger and the sear with the connector assembly and sear coupled through a linkage, interruptable by a disconnector, such that with a safety cross-button pushed to "Safe" position, the trigger, sear and hammer are blocked when the action is closed. The arrangement prevents accidental discharge of the arm in the event it is dropped, struck or disturbed, and so forth.

6 Claims, 3 Drawing Sheets

FIRE CONTROL MECHANISM FOR FIREARMS

BACKGROUND OF THE INVENTION

The present invention relates to fire control mechanisms for firearms.

Early firearms had an external, visible hammer manipulated by the thumb for safety. The present invention relates to so-called "hammerless" firearms wherein the hammer is concealed from view. The safety mechanism for the fire control mechanism depends on the competence of a safety button such as that disclosed in U.S. Pat. No. 2,675,638 to Crittendon. The Crittendon patent discloses a fire control for firearms which has been extensively used in a variety of shotguns and rifles made and sold in the United States for many years.

In ordinary operation of the Crittendon fire control mechanism, a trigger acts through a connector assembly, sear and spring loaded hammer for firing the arm. Initially, the sear engages a hammer hook to hold the hammer in a cocked position, and the sear disengages the hammer hook to fire the arm after a pull of the trigger rotates the sear through the intermediation of the connector assembly. After firing, the slide and bolt assembly recocks the hammer with hammer hook and sear re-engaged so that the firearm is ready to fire with another pull of the trigger.

If the firearm is not to be fired immediately, a trigger block safety device is moved into engagement behind the trigger to immobilize the trigger. In this condition, the firearm is loaded, the hammer is cocked, i.e., the sear engages the hammer hook, and the trigger cannot be actuated to fire the firearm.

Nevertheless, there has been concern that the sear may release the hammer to fire the firearm if the firearm is dropped or otherwise sustains a sharp blow. Any external force to the firearm from being struck or dropped might in turn impart inertial force to the sear causing movement of the sear and release of the hammer to fire the firearm, even though trigger movement is blocked by the safety.

As a result, the trigger block safety mechanism prevents firing of the firearm by means of a trigger pull but does not restrain the sear in cases where the firearm is dropped.

Accordingly, there is need for an improved fire control mechanism that focuses on and improves that characteristic of the Crittendon mechanism wherein the safety blocks only the trigger.

SUMMARY OF THE INVENTION

This invention relates to safety improvements for a common fire control mechanism used in millions of shotguns and rifles of manually operated, recoil, and gas operated semi-automatic types and disclosed in the Crittendon patent.

The present invention provides an improved fire control mechanism for firearms in which a connector is interposed between the trigger and the sear with the connector cooperating with the sear to prevent movement of the sear and release of the hammer while the trigger safety is in "safe" position. The arrangement prevents accidental discharge if the firearm is dropped or otherwise sustains a sharp blow capable of disengaging the sear and hammer hook in a firearm having the Crittendon mechanism.

In a preferred embodiment of the invention, the improved fire control mechanism comprises a trigger, a connector assembly, a sear, a trigger-sear spring, a spring loaded hammer, and a trigger block safety. In an armed position of the mechanism, the trigger block safety is in the "off" position, and the sear engages the hammer hook to cock the hammer. A pull of the trigger actuates the connector assembly to rotate the sear thereby disengaging the hammer hook and releasing the hammer to fire the firearm. In accordance with the invention, the connector assembly and sear are linked to immobilize the sear against rotation in all situations except for a pull of the trigger. Accordingly, with the trigger block safety in the "on" or safe position the trigger is immobilized, and with the connector assembly and sear linked to immobilize the sear, the firearm cannot fire deliberately, inadvertently, or accidentally.

In preferred form, the improved fire control mechanism comprises a linking of the sear and connector assembly by means of a lug formed on the body of the sear, and a slot formed on an arm of the connector assembly. The connector slot normally engages the sear lug to immobilize the sear, that is, to prevent rotation of the sear so as to prevent release to hammer hook; and to maintain the immobility of the sear except when the trigger is pulled. If the firearm is accidentally dropped, the connector-sear link continues to immobilize the sear to maintain sear engagement with the hammer hook. To fire, the trigger is pulled, the connector assembly moves the sear by means of the connector slot first pushing and then disengaging from the sear lug after the sear has released the hammer. After firing, the slide-bolt assembly recocks the hammer with hammer hook and sear re-engaged, and with the connector and sear linked so that the firearm is ready to fire only in the event the trigger is pulled.

A principal difference between the Crittendon design as revealed in U.S. Pat. No. 2,675,638 and my improvement is this: Crittendon pushes the sear with the connector to fire but does not restrain the sear otherwise; whereas, I restrain the sear, that is, push the sear when needed to fire but otherwise restrain the sear by the connector so that the sear has to respond to whatever freedom the trigger allows.

OBJECTS OF THE INVENTION

The principal object of the invention is to make firearms safer by providing that when the breech is closed and the hammer is cocked, the safety blocks not only the trigger but also the sear and the hammer.

It is an object of the invention to provide for linking of the connector assembly and sear so that the hammer falls only when the trigger is pulled.

It is a further object of the invention to provide economy and simplicity in an improved fire control mechanism in that:

i. no additional parts are added, ii. only two parts are in need of alteration, iii. the universality of the fire control to a wide variety of gun models is not compromised, and iv. retrofit of existing models is accommodated.

It is a further object of the invention to provide improvement to the Crittendon '638 fire control mechanism without interference to other vital functions of the fire control such as:

i. disconnection to prevent more than one shot being fired in response to one pull of the trigger, ii. disconnection of firing ability when the breech is unlocked or open, iii. operation of external finger-pieces that enable unlocking of manually operated arms, iv. mounting of shell lifting carriers for chamber loading, v. latching of magazine clips, vi. and stay-open-on-last-shot devices.

Other and further objects of the invention will occur to one skilled in the art with an understanding of the following detailed description of the invention or upon employment of the invention in practice.

DESCRIPTION OF THE DRAWING

A preferred embodiment of the invention has been chosen for purposes of illustrating the construction and operation of the invention and is shown in the accompanying drawing in which.

DETAILED DESCRIPTION OF THE INVENTION

Figure 1:
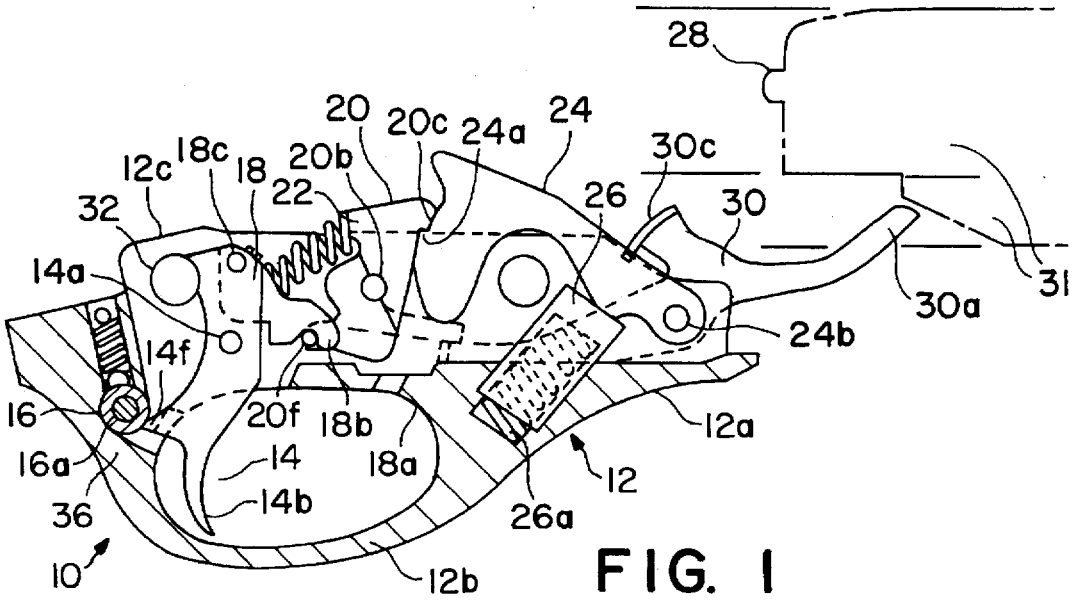
FIG. 1 is a right side elevational view of the trigger plate assembly, the body of the fire control housing, showing the hammer cocked but without shell lifting carriers or magazine clips.

Referring now to the drawing, an improved fire control mechanism according to the invention comprises a trigger assembly 10 for shotguns and rifles. The right side of the trigger assembly is illustrated in FIG. 1 and includes a trigger plate 12, trigger 14, trigger block safety 16, connector assembly 18, sear 20, trigger-sear spring 22, hammer 24, and hammer spring plunger 26. In the cocked position of FIG. 1, the sear 20 engages and holds the hammer hook **24*a* against the force of the hammer spring 26*a* acting through the hammer spring plunger 26. FIG. 1 also illustrates right connector arm 18*b* engaging a sear lug 20*f* thereby establishing a link between the connector assembly and the sear. When the trigger is pulled, the connector assembly rotates the sear counterclockwise to release the hammer, and the hammer is propelled by the hammer spring plunger in an arc about its pivot pin 24*b* and strikes the firing pin 28**.

Figure 1A:
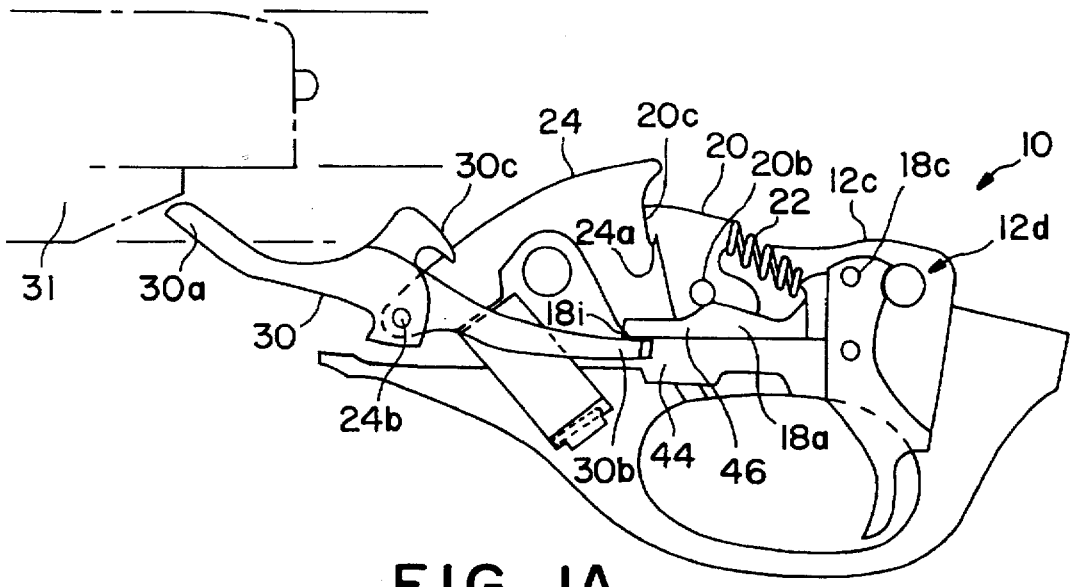
FIG. 1*a* is a left side elevational view of the trigger plate assembly of FIG. 1.
Figure 2:
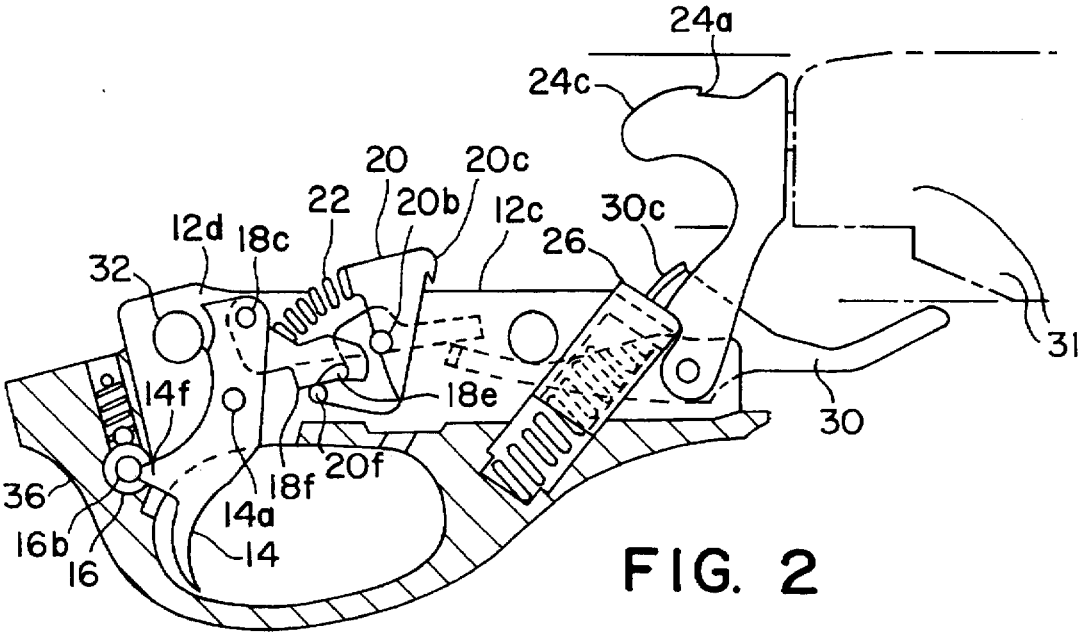
FIG. 2 is a right side elevational view of the trigger plate assembly of FIG. 1 with the hammer in fired position, and with the sear disconnected.
Figure 2A:
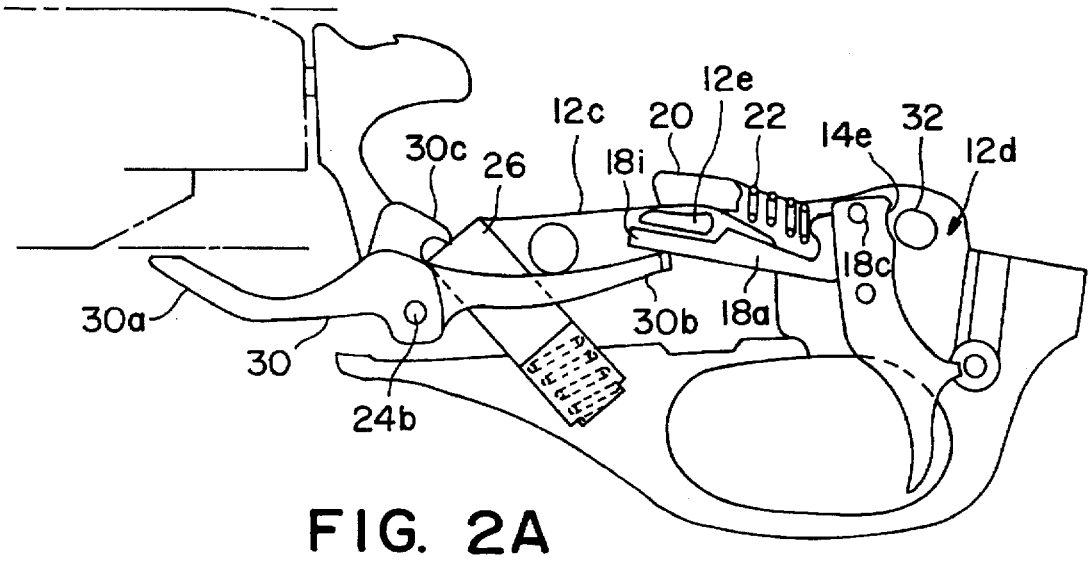
FIG. 2*a* is a left side elevational view of the trigger plate assembly of FIG. 2.

The left hand side of the trigger assembly is shown in FIGS. 1*a* and 2*a* and includes a long double ended disconnector lever 30 mounted on the same pivot pin **24*b* as the hammer, and the left arm 18*a* of the connector assembly. The disconnector lever has two functions: (i) the front end 30*a* prevents engagement of the right connector arm 18*b* with the sear lug 20*f* (FIG. 1) if the gun breech (not shown) is not closed and locked, and (ii) the back end 30*b* engages the connector left arm 18*a* for lifting and holding the connector assembly 18** in raised position after the hammer falls.

A detailed description of the interaction of trigger assembly components is set forth below following the detailed description of the trigger assembly components now given.

The trigger plate 12 has a main body portion **12*a* with a trigger guard 12*b*, and upstanding side plates 12*c* defining recesses 12*d*** for receiving and aligning the components of the trigger assembly.

The trigger 14 is mounted for rotation about a trigger pin **14*a* extending laterally between the side plates. The trigger includes a depending finger piece 14*b* and a pair of arms 14*c*, 14*d* (FIG. 3) extending upwardly of the trigger pivot pin. Movement of the trigger in a counterclockwise direction (FIGS. 1 & 2) about its pivot pin is limited by a transverse tube 32 passing through side plates and registering with notches 14*e* in the upper arms of the trigger. The trigger-sear spring 22 urges the trigger counterclockwise into notch abutment with the retainer tube 32. Rotational movement of the trigger is further restricted by a cross bolt safety 16 slidable through a passage hole 36 across the trigger plate. The cross bolt at its maximum diameter 16*a* (FIG. 1) engages a rearwardly projecting spur 14*f* preventing any movement of the trigger. For movement of the trigger, the cross bolt slides laterally to register the spur with a reduced diameter 16*b*** (FIG. 2) of the bolt. The reduced diameter accommodates trigger movement for firing the firearm.

The upwardly extending trigger arms **14*c*–*d* (FIG. 3) are spaced apart and define a recess 14*g* for mounting the connector assembly 18** for rotation as the trigger rotates about the trigger pin.

The connector assembly is fitted on a connector pivot pin **18*c* which extends laterally through the spaced trigger arms such that the connector assembly moves as the trigger moves and also rotates about its own pivot pin 18*c*. The connector assembly includes left hand connector arm 18*a* and a right hand connector arm 18*b* which are notched together to rotate about the connector pivot pin 18*c*** as though they were a single part.

The connector arms have matching knobs **18*d* (FIG. 3) just forward of and below their pivot pin, and the knobs together form a button for engaging one end of the trigger-sear spring 22. The sear 20 has a corresponding button 20*a* above a sear pivot pin 20*b* axis for receiving the other end of the spring. The spring 22** is held in compression between the connector assembly and the sear always urging the connectors to rotate downward (clockwise in FIG. 1) as a unit about their pivot pin and urging the sear to rotate clockwise about its pivot pin.

The sear is rotatably mounted on its pivot pin and includes a forwardly oriented hooked edge **20*c* for engaging and retaining the hammer 24 in cocked position with the trigger-sear spring urging the sear into engagement with the hammer hook 24*a***. The trigger-sear spring urges the fingerpiece of the trigger in a forward direction (counterclockwise), and urges the sear clockwise into position where the sear can latch the hammer, or be ready to latch the hammer when the hammer hook rotates past the sear.

The sear has a recess **20*d* (FIG. 3) defined by a shoulder 20*e* with a lug 20*f***, preferably cylindrical, projecting from the recess at lower rear corner of the sear.

The right hand connector arm **18*b*** forms part of a safety link with the sear for the purposes of actuating the sear when the trigger fires the firearm, and of immobilizing the sear against movement except when moved by a trigger pull.

In preferred form shown in FIGS. 1, 2, 3 and 4, the right hand connector **18*b* is an elongate arm extending forwardly and downwardly from the connector pivot pin 18*c* with a front portion positioned adjacent the sear lug 20f. The connector arm has an open-ended slot 18e extending upwardly and forwardly from its lower edge 18f for cooperating with the lug and together with the lug defining a trigger assembly link through which the sear is actuated by pull of the trigger and otherwise immobilized in accordance with the invention. The connector slot drops down over the lug to the position of FIG. 1 to form the safety link. The slot includes front 18g and rear 18h face surfaces each of which is radially equidistant (FIG. 4) from the center of the connector pivot pin 18c** such that the path of the slot is radial of the pivot point of the connector assembly. In this way, the slot can "drop down on", that is, the connector slot can engage or "connect" with the sear lug without disturbing the sear position as the sear latches or holds the hammer in cocked position. The sear is blocked from rotation in either direction by the close confinement of the sear lug in the connector slot and by the axis or path of the slot lying normal to the arc of travel of the lug. As a result, movement of the hammer is blocked by immobility of the sear.

FIG. 1 of the drawing illustrates the fire control mechanism in cocked position in which the breech (not shown) is closed and locked, the hammer is latched by the sear, with the connector slot in full engagement with the sear lug 20f, and with the trigger-sear spring 22 urging both the connector slot and lug clockwise so as maintain their engagement. By moving the cross bolt safety to the "Fire" position (FIG. 2), the trigger may now be pulled to fire the firearm. By pulling the trigger, the upper portion of the trigger as well as the connector arm and slot 18e move forward causing the rear face 18h of the slot to push the lug and sear counterclockwise against the force of the trigger-sear spring resulting in disengagement of sear and hammer hook and fall of the hammer. At the end of this movement, as shown in FIG. 2, the slot and lug are completely disengaged with the lower edge 18f of the connector arm aft of the slot now touching the lug and acting as a stop to further rotation of the sear. It is to be noted that during movement of the connector arm, any tendency of the connector slot to slide up off the sear lug is countered by the biasing force of the trigger-sear spring.

The left hand side of the trigger assembly (shown in FIGS. 1a and 2a) includes the long double ended disconnector lever 30 mounted on the same pivot pin 24b as the hammer. The disconnector has an end portion 30b positioned beneath a forward portion 18i of the connector left arm 18a. The disconnector also has a short right angle bend 30c which projects into the path of the hammer spring plunger 26. When the hammer is cocked (FIGS. 1 and 1a), the connector arm 18a pushes the disconnector end portion 30b downward while raising the forward leg 30a of the disconnector to a position up behind the slide-bolt assembly 31. The breech must be closed and locked to accommodate a rising forward leg, so that if the breech is open, the slide-bolt assembly continues to depress the disconnector, and it in turn, prevents the open slot of the right connector arm from engaging the sear lug even though the hammer then may have recocked.

After the trigger is pulled (FIGS. 2 and 2a) and the hammer strikes the firing pin, the hammer spring plunger at the end of its travel engages the right angle bend 30c of the disconnector and urges the forward leg 30a of the disconnector downward so that rear end portion 30b rises and pushes the left hand connector arm 18a upward against a block 12e forming part of a side plate. At the same time, the connector right arm 18b also moves upward to the position of FIG. 2 completely lifting the slot 18e above the lug 20f, and remains in this position until the breach is fully closed and locked.

In operation beginning with the hammer cocked and trigger assembly components in the positions shown in FIGS. 1 and 1a, a pull of the trigger overcomes the resistance of the trigger-sear spring, moves the connector assembly forward, the slot face 18h of connector right arm pushes against the sear lug 20f, the sear rotates counterclockwise and disengages the hammer hook with the hammer striking the firing pin. After the hammer falls, the trigger and sear spring urges the trigger counterclockwise and the sear clockwise. The trigger-sear spring rotates the sear clockwise in anticipation of recocking and the sear comes to rest when the sear encounters the lower edge 18f of the right hand connector arm just aft of the connector slot.

The trigger assembly maybe recocked by rotation of the hammer counterclockwise toward the sear. First, the hammer reengages and overcomes the propelling force of the hammer spring plunger while the plunger telescopes over its spring and retreats into the trigger plate. The retreating plunger disengages the right angle bend 30c of the disconnector thereby freeing the disconnector and removing the upward force applied to the connector left arm by the rear portion of the disconnector. In this way the connector assembly is no longer forced upward by the action of the hammer spring. However, the connector assembly remains in position because the forward leg 30a is still controlled in depressed position by the bolt-slide assembly above it until such time as the breech is finally closed. The hammer however has earlier been reengaged by the sear.

Initial contact between hammer and sear occurs at the interface of hammer lobe rear surface 24c and sear front surface 20c. As the hammer proceeds in counterclockwise direction, the hammer lobe engages and rotates the sear counterclockwise, compresses the trigger-sear spring causing clockwise rotation of the connector assembly with the connector slot dropping down to engage the sear lug and block rotation of the sear as long as the slot and lug link remains engaged. This linking occurs after the hammer hook reengages the sear. So, by continuing counterclockwise rotation of the hammer, the sear is engaged and the hammer recocked.

The connector right arm slot 18e can rise and disengage from the sear lug 20f readily under several conditions: (i) when the sear is latching the hammer and the trigger is back against its tubular stop with the safety on or off, (ii) after a pull of the trigger, in the instant just before the hammer strikes the firing pin as the hammer spring plunger rotates the disconnector, and (ii) anytime the breech is unlocked or opened manually.

But in the reverse case, the slot can drop down on the sear lug only when the sear is in the position wherein it latches the hammer and simultaneously the trigger is back against its stop. In all other situations, misalignment of the slot with the sear lug prevents reconnection.

Figure 3:
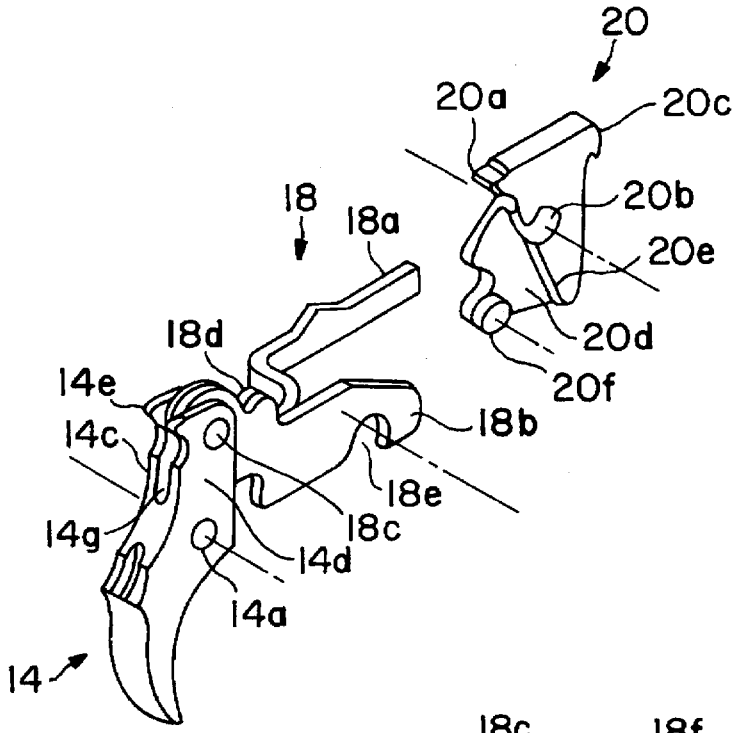
FIG. 3 is an exploded, isometric protection of the trigger, connector assembly with its left and right connector arms, and the sear with a round, projecting sear lug on its lower right side.
Figure 4:
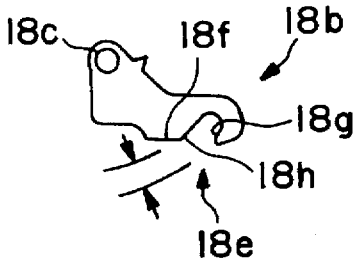
FIG. 4 is a side elevational view of the connector right arm according to the invention.
Figure 5:
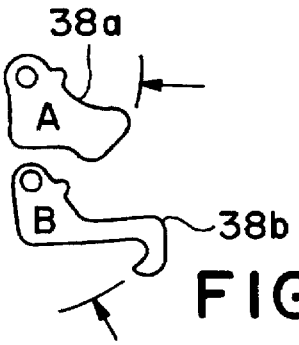
FIG. 5 is a right side elevational view of a modified embodiment of connector assembly/sear linking components according to the invention.

FIG. 5 illustrates a modified embodiment of the connector right arm comprising separate parts 38a and 38b which acting together have the same effect as the connector right arm 18b of FIGS. 1–3. Part 38a acts as a pusher performing the function of rear face 18h of slot 18 with part 38b acting as the front face 18g of the slot.

Part 38b, by itself, can be retrofitted to older sporting firearms such as disclosed in Crittendon '638 to provide a connector sear safety link. In such retrofit, the part 38b would engage a sear lug as disclosed herein.

Figure 6:
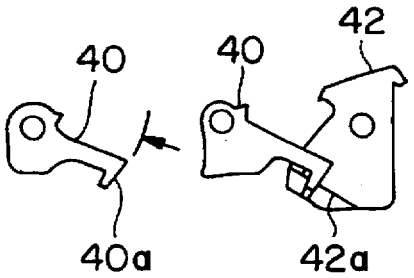
FIG. 6 is a right side elevational view of another modified embodiment of connector assembly/sear linking components according to the invention.

FIG. 6 illustrates a further modification comprising connector right arm 40 having a hook 40a for engaging a slot 42a formed on the sear 42.

As noted, the trigger assembly is fitted with a cross bolt safety to prevent any movement of the trigger and blocking normal actuation of the fire control mechanism. The possibility of the sear releasing the hammer accidentally or by other abnormal manner while the safety is in "On safe" position, as by dropping the firearm and disrupting the sear/hammer hook engagement, is foreclosed by the safety link between connector right arm and sear in which the connector slot engages and holds the sear lug to prevent counterclockwise rotation of the sear and release of the hammer. The link itself cannot be accidentally disconnected during "On Safe" position because the trigger cannot move and neither can the connector right arm. If the firearm is dropped or struck with sufficient force to disrupt the latching of sear and hammer hook, the connector right arm nonetheless maintains its hold on the sear lug or slot (FIG. 6) to prevent rotation of the sear and release of the hammer.

With the firearm loaded and the safety pushed to the "Fire" position prior to a discharge at a target, it is a safety advantage that the trigger, connectors, and sear are mechanically linked together and into a combined mass. Any external force to the firearm from being struck or dropped (which might in turn in-part inertial force to a light weight sear acting alone), is opposed here: (i) by the combined inertia of the trigger, the trigger pin, the connector assembly, and the sear; (ii) by sliding friction between these parts as they move in concert; and (iii) by an even stouter trigger-sear spring force because now both ends of the spring must compress before a sear could release a hammer.

The individual parts here described mount on transverse pins passing through the parts, or a cast trigger plate housing. There is an empty cavity 44 (FIG. 1*a*) provided beneath the parts within the housing with through drain ports or outlets 46 in the housing wall because it is known that foreign matter, oil and dust may accumulate in the cavity. In the present mechanism, motion limiting and stop surfaces between component parts are arranged "overhead" of the cavity to avoid interference, or incorrect positioning of parts due to accumulation of foreign matter on bottom surfaces within the cavity.

I claim:

1. An improved fire control mechanism for a firearm having a breech and a bolt slide assembly comprising a trigger, a spring loaded hammer, a sear having means for latching the spring loaded hammer, the sear having a side face with a lug projecting therefrom, a connector assembly pivotally mounted on the trigger, the connector assembly having an elongate arm with a slot for cooperating with the sear lug to define a link for actuating the sear to release the hammer and for immobilizing the sear against movement and release of the hammer except when the trigger is pulled.

2. An improved fire control mechanism as defined in claim 1 which further includes a disconnect lever to prevent linkage of the connector and sear when the breech is not locked.

3. An improved fire control mechanism as defined in claim 2 in which the connector assembly further includes a left arm cooperating with the disconnect lever for disengaging the connector elongate arm slot from the sear lug when the firearm is fired.

4. An improved fire control mechanism for a firearm having a breech comprising a trigger, a sear, a connector assembly pivotally mounted on the trigger and being responsive to a pull of the trigger for actuating the sear, a spring loaded hammer, the sear having means for latching the spring loaded hammer, a trigger block safety selectively movable to a safe position for blocking trigger movement, the connector assembly having a right arm with a hook, the sear having a slot, the hook and slot being linked to immobilize the sear against movement and release of the hammer except when trigger is pulled, so that with the trigger block safety in the safe position the trigger is immobilized, and with the connector assembly and sear linked to immobilize the sear, the firearm cannot fire.

5. An improved fire control mechanism for a firearm having a breech comprising a trigger plate mounting a rotatable trigger, the trigger having a fingerpiece for pulling the trigger to fire the weapon, a sear pivotally mounted to the trigger plate on a horizontal axis, the sear having a recess oriented vertically and a lug projecting horizontally from the recess, a connector assembly rotatably mounted on the trigger and having right and left connector arms, the right connector arm having an open-ended slot for selectively engaging the sear lug for immobilizing the sear and for actuating the sear when the trigger is pulled, a spring loaded hammer, the sear having means for latching the spring loaded hammer, a trigger block safety selectively movable to a safe position for blocking trigger movement, so that with the trigger block safety in the safe position the trigger is immobilized, and with the connector right arm slot and sear lug linked to immobilize the sear, the weapon cannot fire, a disconnect lever actuated by the hammer spring to prevent linkage of the connector and sear when the breech is not closed and locked, and the connector assembly further having a left arm cooperating with the disconnect lever for disengaging the connector slot from the sear lug when the firearm is fired or the breech is opened.

6. An improved fire control mechanism comprising a trigger, a spring loaded hammer, a sear, the sear mounted on a pivot pin and having means above the pivot pin for latching the spring loaded hammer, the sear having a lug projecting to one side of the sear and positioned below the pivot pin, a connector assembly pivotally mounted on the trigger, the connector assembly having an elongate arm with a front portion positioned adjacent the sear lug, the arm having an elongate slot for cooperating with the lug to define a trigger assembly link through which the sear is actuated by pull of the trigger to release the hammer, a trigger block safety selectively movable to a safe position for blocking trigger movement, the connector assembly and sear being linked by lug and slot cooperation to immobilize the sear against movement except for a pull of the trigger, so that with the trigger block safety in the safe position the trigger is immobilized, and with the connector assembly and sear linked to immobilize the sear, the firearm cannot fire.

* * * * *